US005140837A

United States Patent [19]

Thomas et al.

[11] Patent Number: 5,140,837

[45] Date of Patent: Aug. 25, 1992

[54] PROCESS FOR ROLLING SOFT METALS

[75] Inventors: John E. Thomas, Pittsburgh, Pa.; Chung Ryu, Cedar Rapids, Iowa; In H. Ryu, Cedar Rapids, Iowa; Gordon K. Young, Cedar Rapids, Iowa; Joong H. Shin, Cedar Rapids, Iowa

[73] Assignees: Tippins Incorporated, Pittsburgh, Pa.; PMX Industries, Inc., Cedar Rapids, Iowa

[21] Appl. No.: 706,318

[22] Filed: May 28, 1991

[51] Int. Cl.[5] ..... B21B 1/34; C21D 8/02

[52] U.S. Cl. ..... 72/229; 72/366.2; 148/680

[58] Field of Search ..... 72/227, 229, 231, 234, 72/39, 40, 201, 202, 365.2, 366.2; 148/11.5 C, 13.2

[56] References Cited

U.S. PATENT DOCUMENTS

| | | | |
|---|---|---|---|
| 2,063,677 | 12/1936 | Hughes et al. | 72/366.2 |
| 3,806,366 | 4/1974 | Cofer et al. | 72/39 |
| 4,354,880 | 10/1982 | Adams et al. | 148/11.5 C |
| 4,430,874 | 2/1984 | Tippins et al. | 72/202 |
| 4,583,387 | 4/1986 | Thomas et al. | 72/229 |
| 4,630,352 | 12/1986 | Ginzburg et al. | 72/227 |
| 4,658,363 | 4/1987 | Tippins et al. | 72/366.2 |
| 5,036,689 | 8/1991 | Sekiya et al. | 72/39 |

FOREIGN PATENT DOCUMENTS

| | | | |
|---|---|---|---|
| 0273607 | 11/1989 | Japan | 72/40 |

*Primary Examiner*—Lowell A. Larson
*Assistant Examiner*—Thomas C. Schoeffler
*Attorney, Agent, or Firm*—Webb, Burden, Ziesenheim & Webb

[57] ABSTRACT

The method of processing soft metal slabs to strip thickness on a processing line including providing a hot reversing mill having coiler furnaces on either side thereof along the processing line; heating the slab to a hot working temperature; passing the heated slab through the hot reversing mill at least one time to reduce the thickness thereof to form an intermediate product of a coilable thickness; coiling the intermediate product in one of the coiler furnaces; passing the intermediate product back and forth through said hot reversing mill and between the coiler furnaces to reduce the intermediate product to a product having a strip thickness; processing the product of strip thickness through a quench; and surface cleaning the quenched product. No subsequent hot rolling, hot milling, cold reduction or anneal takes place prior to forming the product of strip thickness.

4 Claims, 2 Drawing Sheets

PROCESS FOR ROLLING SOFT METALS

BACKGROUND OF THE INVENTION

1. Field of the Invention

Our invention relates to the processing of soft metals, and more particularly, to a method of rolling copper and copper alloys such as brass from a slab to a product of strip thickness.

2. Description of the Prior Art

Conventional rolling of soft metals such as copper, and copper alloys such as brass, is carried out by reducing a slab on a hot mill to a product of intermediate thickness. Thereafter, the intermediate product is quenched and the outer surface removed before being processed on a multiple stand cold mill to strip thickness. The cold rolled product of strip thickness is then annealed and finally chemically descaled and buffed or scalped. These processing lines are often extremely long and may require crossover facilities or other material handling equipment during processing.

The metallurgy of alloys of these materials is complex because of numerous phases formed on cooling from the melt, because alloy components have much higher vapor pressures than the parent alloy and because oxidation proceeds at and below the original outer surface (internal oxidation). All of these phenomena lead to an outer layer that is completely different than the interior of the slab to the extent that it is used as a sacrificial envelope that is removed by milling after initial breakdown of the slab. These phenomena are made more severe by processing the material in small batches.

Drawbacks to conventional processing lines and processes for these soft metals include substantial yield losses which come from the hot rolling process and subsequent milling prior to cold rolling. In addition, there is always the risk that surface imperfections are not properly removed and may be carried through to finished product. Further, the milling operation necessary for removing the outer surface of the hot rolled product results in a roughened surface which likewise may be carried through to the finished product. Conventional processing lines limit the slab sizes employed and the coil sizes generated from those slabs as a result of rolling limitations and quenching limitations of intermediate slab thicknesses.

The prolonged exposure of the slab being rolled to the atmosphere can result in selective evaporation of certain of the non-ferrous metals in the alloys and diffusion of oxygen into the subsurface. This explains the need for the milling operations following the quench.

The need remains for a compact processing line for soft metals such as copper, and copper alloys such as brass.

SUMMARY OF THE INVENTION

Our process for reducing soft metals from slabs to strip thicknesses can be accomplished on a mill arrangement having limited space requirements and a reasonable initial cost. Our processing technique likewise permits larger slabs and larger resultant coils. Since conventional processing steps are eliminated, productivity is substantially increased. In addition, scale formation, selective vaporization and subsurface diffusion is minimized, thereby further simplifying subsequent processing and improving the surface quality of the final product of strip thickness.

Our method of processing of soft metal slabs to strip thicknesses comprises providing a hot reversing mill having coiler furnaces on either side thereof along the processing line, heating a slab to hot working temperature and passing the heated slab back and forth through the hot reversing mill and then coiling it in the coiler furnaces when it has reached a thickness capable of being coiled. Thereafter, the product, which has been reduced to strip thickness, is quenched and descaled without the need for milling, cold reduction or annealing.

DESCRIPTION OF THE PREFERRED EMBODIMENTS

Our invention is directed to the processing of soft metals such as copper, and copper alloys such as brass, from a slab to a product of strip thickness. Other brazing type silver alloys and alloys of lead and titanium or zirconium may be similarly processed.

Figure 1:
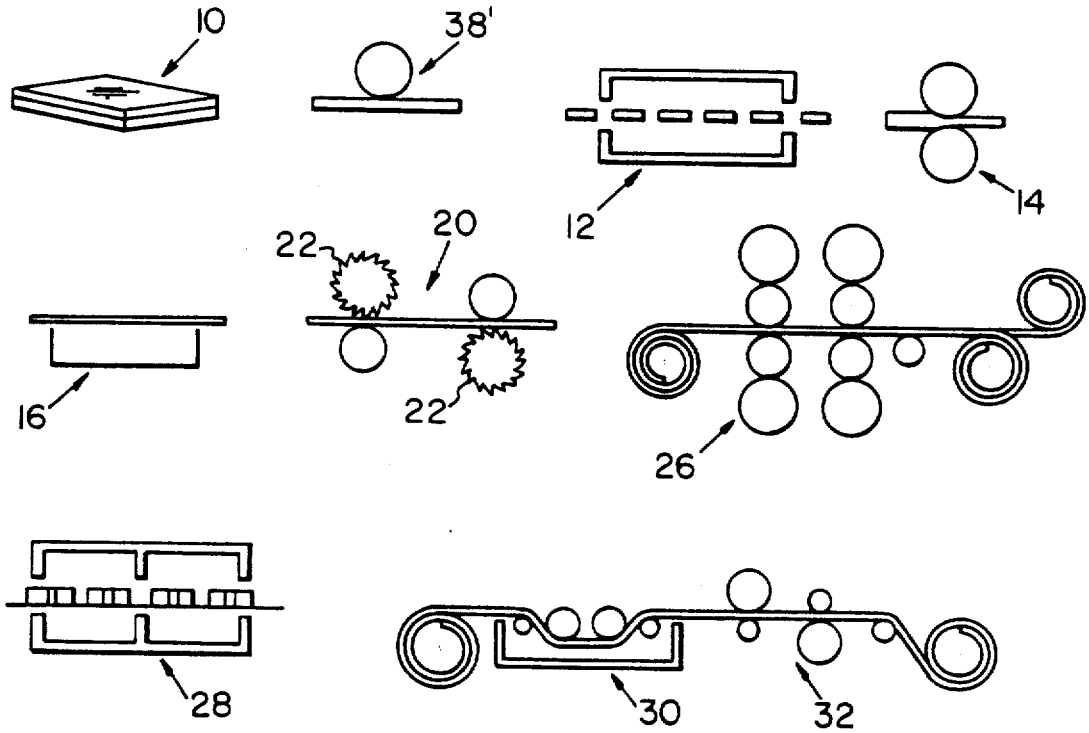
Fig. 1 PRIOR ART
FIG. 1 is a schematic of the conventional prior art hot processing line.

One form of the traditional or conventional process is illustrated in FIG. 1. Slabs generally designated 10 are formed through conventional techniques such as direct chilling with a typical slab size being on the order of 6½ inches by 33 inches by 27 feet. These slabs 10 are milled on a milling station 38' and fed into a slab heating furnace 12 which for brass will operate at a temperature on the order of 1600° F. with the cycle time being on the order 8.7 minutes. The heated slab exits the furnace and continues on a pass line to a hot reversing mill where it is passed back and forth in flat form until it reaches an intermediate thickness. Such a rolling operation will consist of a number of passes with the resultant intermediate product having a thickness of about 0.5 inches. The intermediate product is also flat or plate form. This product is then passed through a quenching operation 16. The quenching operation can be a series of water sprays or typically a water tank 16 into which the intermediate product is placed.

It is also possible to reduce the intermediate product to a thickness which can then be coiled and processed in coil form thereafter. At this point in the processing, because of the large number of flat rolling passes through the hot reversing mill in which the heated product is completely unprotected, a substantial amount of scale, selective vaporization or internal oxidation caused by the diffusion of oxygen has occurred. In other words, substantial surface must be removed to achieve a homogenous surface. Following quenching, the product is normally placed on a crossover table and introduced onto a parallel pass line including an overhauler generally designated 20. The overhauler consists of two sets of rolls 22 with one of each set of rolls having a plurality of knife surfaces so as the product passes through the rolls, the surface of the product is cut or milled to remove the outer surface. The cutting roll of each roll pair is on opposite sides of the intermediate product from the cutting roll of the other pair so as to mill both the top and bottom surface of the intermediate product which is flat passed through the overhauler 20. At least 0.01 inches is taken off each side of the intermediate product. The typical line speed for such an overhauling operation is on the order of 40 feet per minute. These slow speeds create a production bottleneck.

The intermediate product is then cold reduced on a two-stand tandem mill generally designated 26 into coil form or on a single stand mill which may or may not be of the reversing type. The thickness of the intermediate product is reduced to a strip thickness on the order of 0.10 inches or less in a series of passes. Because the product has now been cold worked, it is subsequently sent through a annealing furnace 28. A typical anneal for brass is on the order of 950° F. for 360 minutes. The annealed coils are then finished on a chemical treat or pickling line 30, and finally, the strip thickness product is buffed or scalped by the appropriate work station 32 upon leaving the pickling tank 30.

Figure 2:
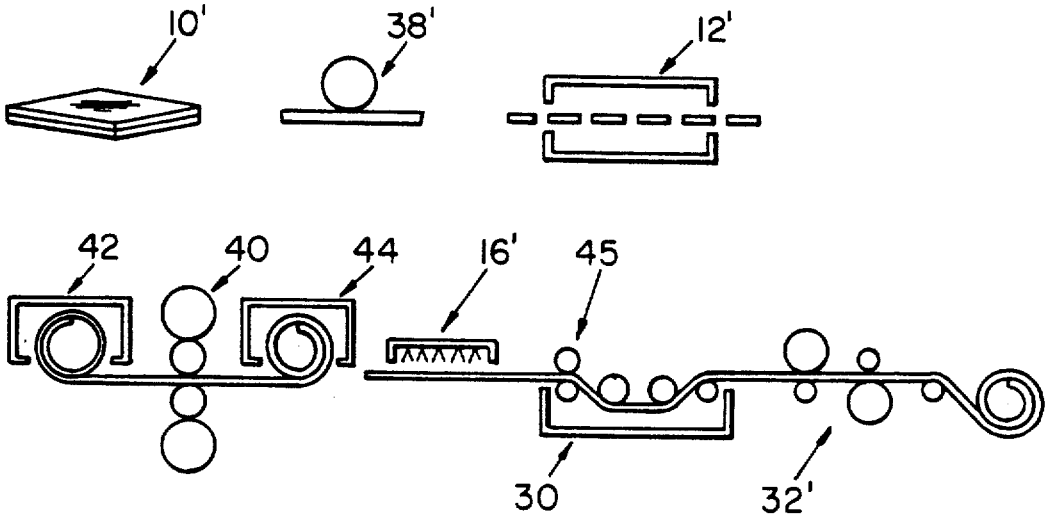
FIG. 2 is a schematic showing the improved processing of our invention.

Our improved processing for soft metals is illustrated in FIG. 2 with typical rolling schedule shown in Table 1. The direct chilled or otherwise formed slabs 10' may be initially passed through an optional slab milling station 38'. The slab is then heated in a reheat furnace 12' prior to hot reduction. The hot reduction takes place on an in-line hot reversing mill 40 having an upstream coiler furnace 42 and a downstream coiler furnace 44. The slab is passed back and forth through the hot reversing mill 40 for 9 passes until it reaches a thickness capable of being coiled (less than one inch thickness) and thereafter the product is passed back and forth (passes 10 through 17) through the hot reversing mill 40 between the coiler furnaces 42 and 44. Rather than forming an intermediate thick gauge product as in the traditional processing of FIG. 1, the slab is reduced all the way down to a strip thickness of 0.118 inches in the example of Table 1 or less. Because the product is coiled in a coiler furnace where reducing gases are formed and an oxygen lean environment exists, the coil is not exposed for prolonged periods to an oxygen bearing environment which allows for selective evaporation of one of the alloy components to form a depleted surface thickness or for internal oxidation as oxygen diffuses into the subsurface.

Typically, the rolled product would be coiled in the upstream coiler furnace 42 on the penultimate pass and on the final pass through the mill at a temperature of 805° F. would pass directly into the quenching operation 16'. The coiled length is on the order of 729 feet. Because the thickness is now at strip thickness, quenching is substantially quicker because of the greater heat loss from the thinner section. The strip is quenched to ambient temperature. The strip can then pass directly into the chemical pickle tank 30 and through the final buffing and/or scalping station 32'. A pair of bridle rolls 45 at the entry end of the pickling tank 30 maintain the necessary tension on the strip thickness product so that it can be effectively carried through the pickling and buffing or scalping operations. It is envisioned that all of the processing steps are carried out in-line and that there is no need for crossover tables and the like. The maximum flat rolled length is about 94 feet.

Figure 3:
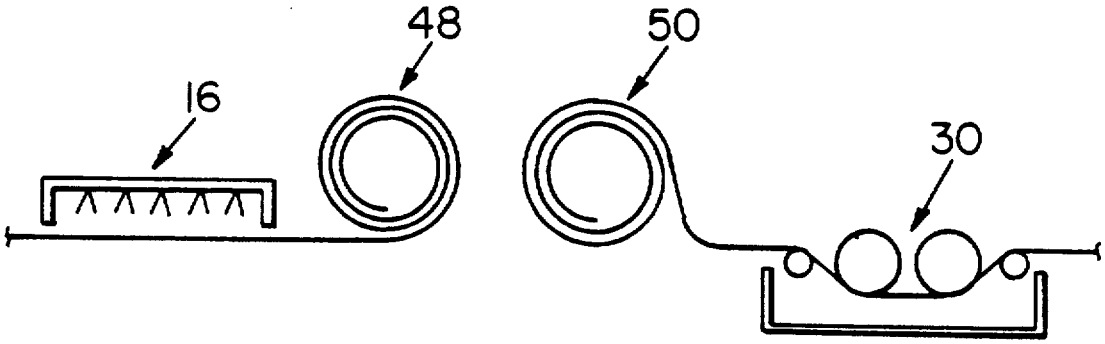
FIG. 3 is a modified embodiment of our processing using coiling and decoiling subsequent to quenching.

It is also possible to separate the quenching operation from the subsequent cleaning operation by use of coiler 48 and decoiler 50, FIG. 3. After water quenching, the strip thickness product is coiled on the coiler 48. Thereafter, the coil is transferred in-line to a decoiler 50 where it is fed into the subsequent descaling operation 30. This permits the quenching and descaling to operate independent of one another, although in the same line.

Figure 4:
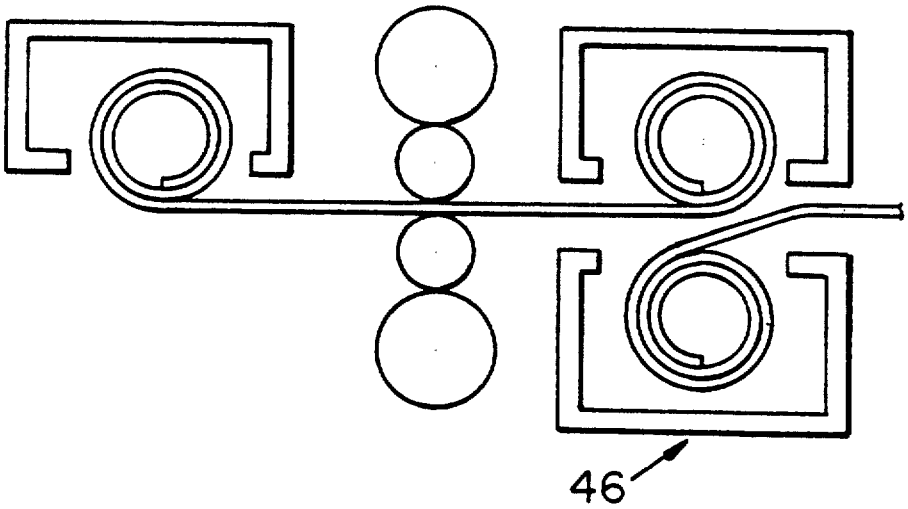
FIG. 4 is a further modification of our processing which includes downstream vertical coiler furnaces.

It is also possible to use a pair of coiler furnaces disposed vertically to one another at the downstream side of the hot reversing mill, see FIG. 4. The coiler furnace 46 is in vertical alignment with coiler furnace 44 with each coiler furnace being on an opposite side of the pass line from the other. While a first coil is being reduced by passing it through the hot reversing mill 40 between coiler furnace 42 and coiler furnace 44 a second coil, which has been previously coiled in coiler furnace 46, is being fed into the subsequent quenching operation. This permits the hot reduction to take place at the same time quenching is taking place.

TABLE I

Rolling Schedule

Reheat 1450° F.
Coiling Drums @ 800° F.
Slab
Length 146 inches
Width 25.591 inches
Thick 7.087 inches

| Pass # | Redn % | Gauge In. | Speed FPM | Force Tons | Pass Sec | Length Ft | Temp Deg |
|---|---|---|---|---|---|---|---|
| 1 | 10.00 | 6.378 | 350 | 390 | 2 | 13 | 1355 |
| 2 | 12.00 | 5.613 | 350 | 461 | 3 | 15 | 1311 |
| 3 | 14.00 | 4.827 | 350 | 510 | 3 | 18 | 1286 |
| 4 | 16.00 | 4.055 | 350 | 542 | 4 | 21 | 1269 |
| 5 | 18.00 | 3.325 | 350 | 561 | 4 | 26 | 1256 |
| 6 | 21.00 | 2.627 | 350 | 569 | 6 | 33 | 1255 |
| 7 | 25.00 | 1.970 | 350 | 660 | 7 | 44 | 1202 |
| 8 | 32.00 | 1.340 | 350 | 798 | 11 | 64 | 1146 |
| 9 | 32.00 | 0.911 | 350 | 797 | 16 | 94 | 1093 |
| 10 | 33.00 | 0.610 | 350 | 806 | 24 | 141 | 1046 |
| 11 | 32.00 | 0.415 | 350 | 773 | 36 | 207 | 1004 |
| 12 | 30.00 | 0.290 | 350 | 723 | 51 | 296 | 967 |
| 13 | 25.00 | 0.218 | 550 | 626 | 43 | 395 | 957 |
| 14 | 5.00 | 0.207 | 550 | 248 | 45 | 416 | 915 |
| 15 | 5.00 | 0.197 | 550 | 247 | 48 | 437 | 870 |
| 16 | 25.00 | 0.147 | 550 | 609 | 64 | 583 | 829 |
| 17 | 20.00 | 0.1180 | 550 | 519 | 80 | 729 | 805 |

We claim:

1. A method of rolling copper and copper alloys from a slab on the order of at least four inches thick to strip thickness on the order of 0.1 inches or less on a processing line comprising:
   (a) providing a hot reversing mill having at least one coiler furnace on either side thereof along the processing line;
   (b) heating a slab to a hot working temperature;
   (c) passing said heated slab through said hot reversing mill to form an intermediate product of coilable thickness;
   (d) coiling said intermediate product in one of said coiler furnaces;
   (e) passing said intermediate product back and forth through said hot reversing mill and between said coiler furnaces to reduce said intermediate product to a strip having a strip thickness;
   (f) quenching said strip; and
   (g) surface cleaning said quenched strip by at least one of pickling, buffing or scalping; wherein no subsequent hot rolling, hot milling, cold reduction or anneal takes place prior to forming the strip of strip thickness.

2. The method of claim 1 including providing two coiler furnaces downstream of said hot reversing mill, said two coiler furnaces being in vertical alignment with one furnace above a pass line and the other furnace below the pass line, whereby while one downstream coiler furnace is receiving the intermediate product from the hot reversing mill, the other downstream furnace is paying off product of strip thickness through a quenching media.

3. The method of claim 1 including providing an in-line quench means downstream of the downstream coiler furnace.

4. The method of claim 3 including coiling the strip subsequent to quenching and paying off said strip prior to surface cleaning.

* * * * *